US009341455B2

(12) United States Patent
Fricke

(10) Patent No.: US 9,341,455 B2
(45) Date of Patent: May 17, 2016

(54) EXPANDING SUBSONIC PROJECTILE AND CARTRIDGE UTILIZING SAME

(71) Applicant: Lehigh Defense, LLC, Quakertown, PA (US)

(72) Inventor: David B. Fricke, Quakertown, PA (US)

(73) Assignee: LEHIGH DEFENSE, LLC, Quakertown, PA (US)

( * ) Notice: Subject to any disclaimer, the term of this patent is extended or adjusted under 35 U.S.C. 154(b) by 82 days.

(21) Appl. No.: 14/298,531

(22) Filed: Jun. 6, 2014

(65) Prior Publication Data

US 2015/0354930 A1 Dec. 10, 2015

(51) Int. Cl.

| | |
|---|---|
| ***F42B 10/00*** | (2006.01) |
| ***F42B 12/34*** | (2006.01) |
| ***F42B 5/16*** | (2006.01) |

(52) U.S. Cl.

CPC .. *F42B 12/34* (2013.01); *F42B 5/16* (2013.01)

(58) Field of Classification Search

USPC ..... 102/510, 517, 518, 439

See application file for complete search history.

(56) References Cited

U.S. PATENT DOCUMENTS

| | | | | |
|---|---|---|---|---|
| 1,023,469 | A | 4/1912 | Haslett | |
| 1,447,478 | A | 3/1923 | Koshollek | |
| 2,765,738 | A | 10/1956 | Frech, Jr. | |
| 3,173,371 | A | 3/1965 | Manshel | |
| 4,550,662 | A | 11/1985 | Burczynski | |
| 5,385,101 | A | 1/1995 | Corzine et al. | |
| 5,400,716 | A | 3/1995 | Mayer | |
| 5,822,904 | A | 10/1998 | Beal | |
| 6,176,186 | B1 | 1/2001 | Engel | |
| 6,805,057 | B2 | 10/2004 | Carr et al. | |
| 6,971,315 | B2 * | 12/2005 | Knappworst | F42B 12/34 102/508 |
| 7,503,260 | B2 | 3/2009 | Kapeles | |
| 7,814,837 | B2 | 10/2010 | Sauvestre | |
| 8,171,852 | B1 | 5/2012 | Rebar | |
| 8,438,767 | B2 * | 5/2013 | Rebar | F42B 12/34 105/509 |
| 9,003,974 | B2 | 4/2015 | Muskat | |
| 2003/0019385 | A1 | 1/2003 | LeaSure | |
| 2008/0216700 | A1 | 9/2008 | Martini Filho | |
| 2014/0318406 | A1 | 10/2014 | Rall | |
| 2015/0354930 | A1 | 12/2015 | Fricke | |

FOREIGN PATENT DOCUMENTS

DE 2843167 A1 4/1980

OTHER PUBLICATIONS

"Lehigh Defense 200gr Maximum Expansion Projectiles and Ammo" located online at: http://300blktalk.com/forum/viewtopic.php?f=151&t=79280, obtained on Nov. 26, 2013, 4 pgs.

(Continued)

*Primary Examiner* — J. Woodrow Eldred

(74) *Attorney, Agent, or Firm* — Merchant & Gould, P.C.

(57) ABSTRACT

An expanding subsonic projectile has a body that has a meplat and at least partially defines a hollow bore having a bore diameter. An insert is disposed at least partially in the bore. The insert includes an insert axis; a tip disposed on the insert axis; a leading section extending from the tip towards the meplat, wherein the leading section has an expanding section diameter along the insert axis from the tip towards the meplat; and a waist extending from the leading section towards the meplat. The waist has a contracting waist diameter along the insert axis from the leading section towards the meplat.

19 Claims, 15 Drawing Sheets

(56) References Cited

OTHER PUBLICATIONS

"Maximum Expansion Bullets and Ammunition", located online at: http://www.lehighdefense.com/index.php/our-technology/maximum-expansion-bullets-and-ammunition#gel-images, obtained on Nov. 26, 2013, 2 pgs.

"Subsonic Bullets", located online at: http://www.corbins.com/subsonic.htm, obtained on Nov. 26, 2013, 5 pgs.

Williams, Anthony G., Tres Haute Vitesse, The Story of the THV and Monad Bullets, May 30, 2014, pp. 1-6, http://www.quarry.nildram.co.uk/THV.htm.

* cited by examiner

EXPANDING SUBSONIC PROJECTILE AND CARTRIDGE UTILIZING SAME

INTRODUCTION

Expanding projectiles direct significant stopping power at a target (e.g., game, enemy combatants) that can help ensure a clean kill of the target. Supersonic projectiles (that is, projectiles discharged from a weapon at greater than about 1040 fps), are propelled with sufficient force so as to expand when hitting any target regardless of projectile profile. Typically, such projectiles are manufactured of lead or copper-jacketed lead, both of which are sufficiently ductile to expand and deform when hitting virtually any barrier or target. The propulsion force of subsonic projectiles, however, is typically insufficient to expand when hitting a target, unless the projectiles are constructed with a fairly blunt profile. Such low caliber projectiles are unable to be fed via a magazine into an automatic or semi-automatic firearm.

SUMMARY

In one aspect, the technology relates to an expanding subsonic projectile having a body having a meplat and at least partially defining a hollow bore having a bore diameter; and an insert disposed at least partially in the bore, wherein the insert includes: an insert axis; a tip disposed on the insert axis; a leading section extending from the tip towards the meplat, wherein the leading section includes an expanding section diameter along the insert axis from the tip towards the meplat; and a waist extending from the leading section towards the meplat, wherein the waist has a contracting waist diameter along the insert axis from the leading section towards the meplat. In an embodiment, the body defines a maximum body diameter and a meplat body diameter of greater than about 30% of the maximum body diameter. In another embodiment, the body defines a maximum body diameter and a meplat body diameter of about 70% of the maximum body diameter. In yet another embodiment, the insert and bore form a friction fit. In still another embodiment, the body includes a plurality of discrete petals, wherein each petal is separated from an adjacent petal by a slot defined by the body.

In another aspect of the above embodiment, the body has three petals. In an embodiment, the body includes a body ogive radius and defines a reference curve extending from the meplat to the insert axis, wherein the reference curve includes a reference curve radius identical to the body ogive radius, and wherein the tip and leading section are contained within the reference curve. In another embodiment, the leading section includes a maximum section diameter between about 60% and about 65% of the bore diameter. In yet another embodiment, the waist has a waist diameter at the meplat, wherein the waist diameter at the meplat is between about 35% and about 40% of the maximum section diameter. In still another embodiment, the waist diameter at the meplat is between about 45% and about 50% of the bore diameter.

In still another aspect of the above embodiment, the expanding subsonic projectile further has a meplat distance from the tip to the meplat and a leading section distance from the tip to the waist, wherein the leading section distance is between about 95% and about 100% of the meplat distance. In an embodiment, the insert is adapted to direct a fluid flow within the bore towards the plurality of discrete petals when the projectile is discharged from a firearm at a subsonic speed into a wet target.

In another aspect, the technology relates to a cartridge having: a casing; a primer disposed at a first end of the casing; a body at least partially defining a hollow bore and having a meplat; an insert disposed at least partially in the bore, wherein the insert has an insert axis, a tip, and a leading section, and wherein the body has a body ogive radius and defines a reference curve extending from the meplat to the insert axis, wherein the reference curve includes a reference curve radius identical to the body ogive radius, and wherein the tip and leading section are contained within the reference curve. In an embodiment, the leading section extends from the tip towards the meplat, wherein the leading section has an expanding section diameter along the insert axis from the tip towards the meplat. In another embodiment, a waist extending from the leading section towards the meplat, wherein the waist has a contracting waist diameter along the insert axis from the leading section towards the meplat. In yet another embodiment, the leading section has a maximum section diameter between about 60% and about 65% of the bore diameter. In still another embodiment, the waist has a waist diameter at the meplat, wherein the waist diameter at the meplat is between about 35% and about 40% of the maximum section diameter.

In another embodiment of the above aspect, the waist diameter at the meplat is between about 45% and about 50% of the bore diameter. In an embodiment, a meplat distance from the tip to the meplat and a leading section distance from the tip to the waist, wherein the leading section distance is between about 95% and about 100% of the meplat distance. In another embodiment, the body has a plurality of discrete petals, wherein each petal is separated from an adjacent petal by a slot defined by the body, and wherein the insert is adapted to direct a fluid flow within the bore towards the plurality of discrete petals when the projectile is discharged from a firearm at a subsonic speed into a wet target.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1A:
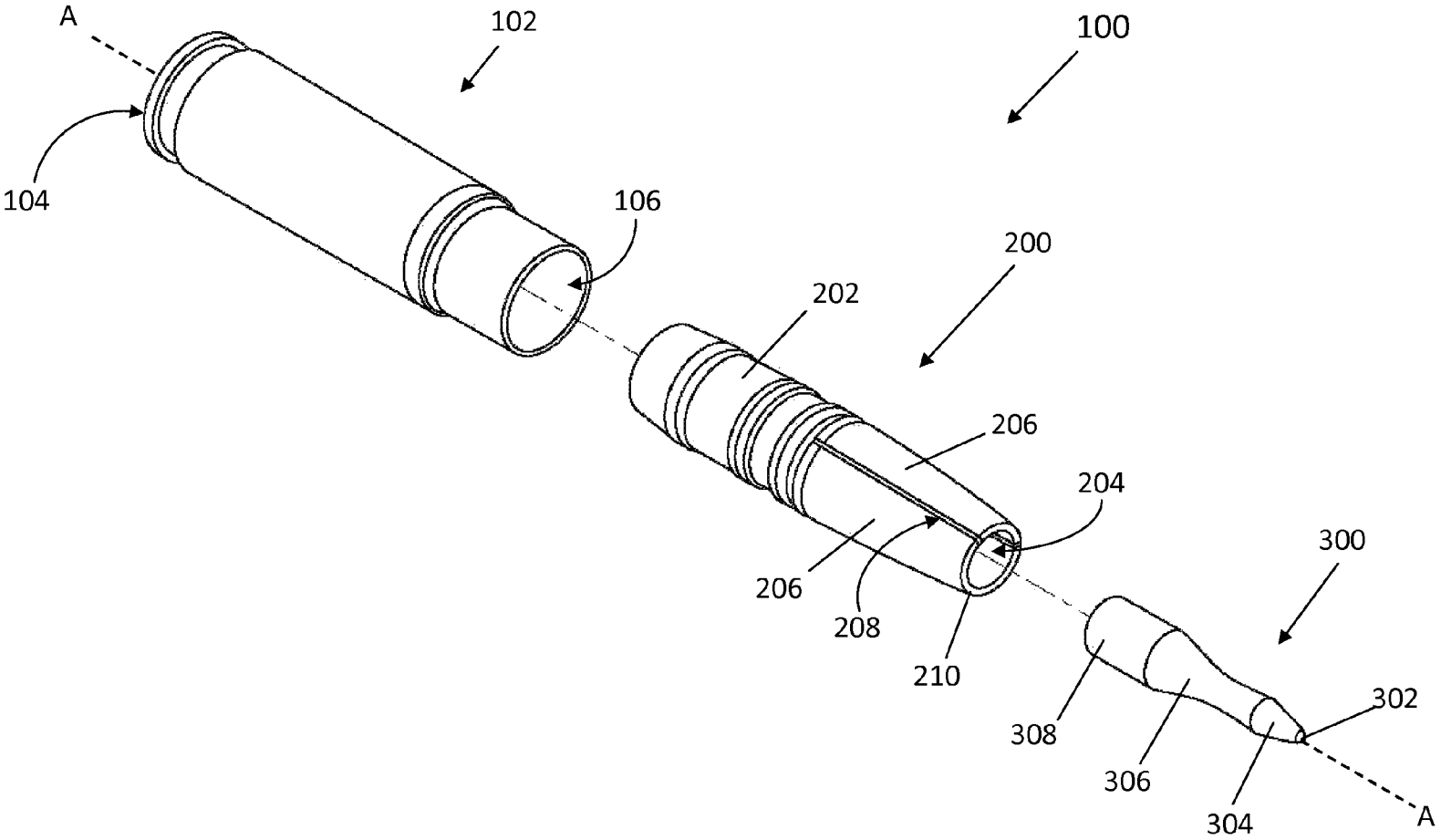
FIG. 1A is an exploded perspective view of an embodiment of a cartridge utilizing a expanding subsonic projectile.
Figure 1B:
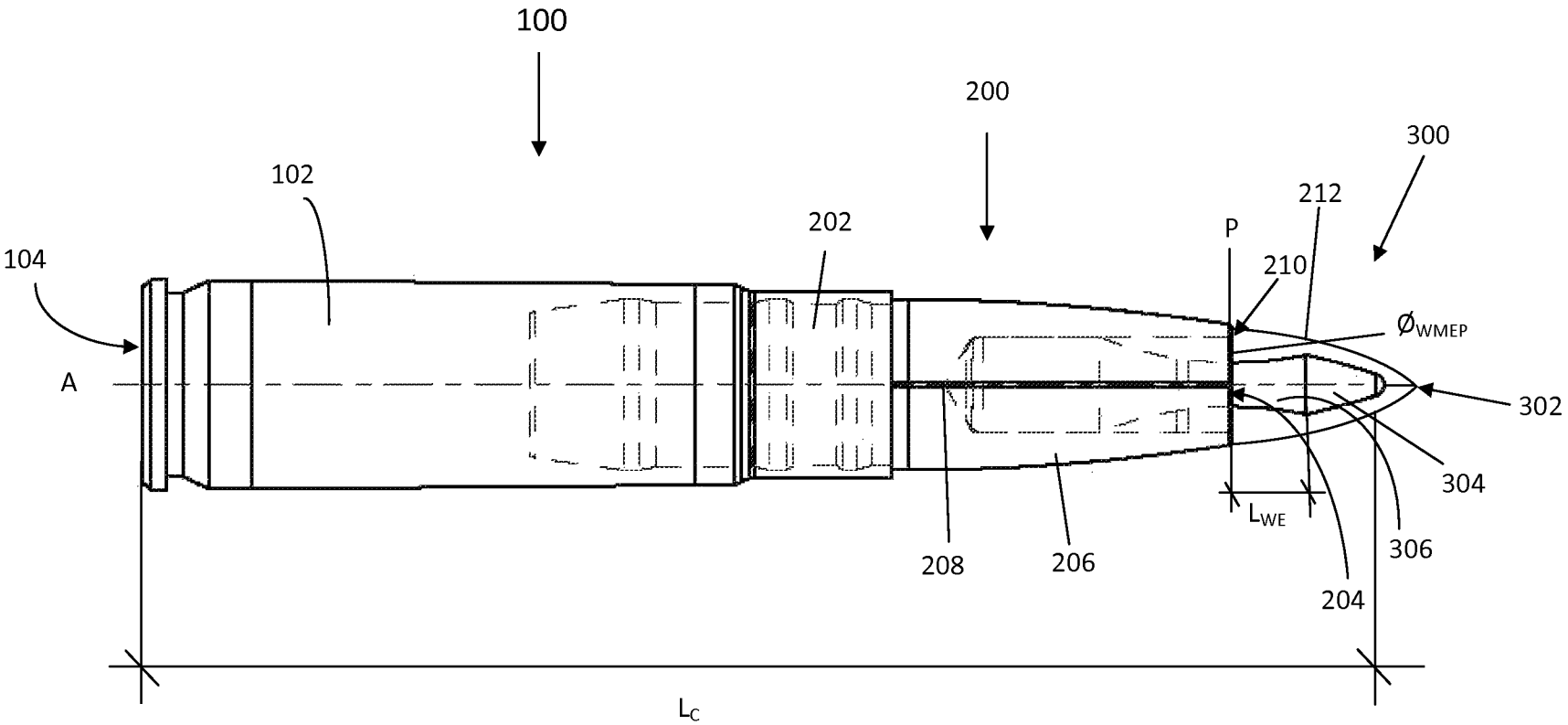
FIG. 1B is a side view of the cartridge of FIG. 1A.
Figure 2A:
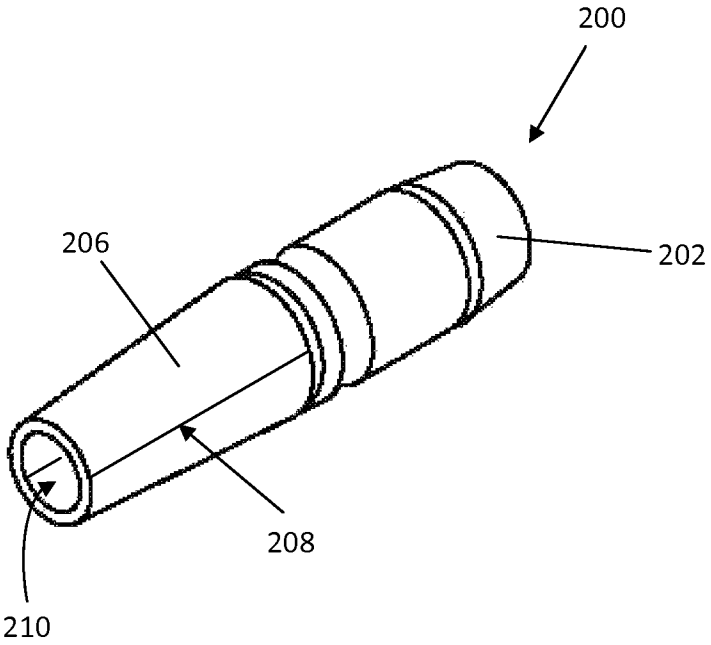
FIG. 2A is a perspective view of an embodiment of an expanding subsonic projectile.
Figure 2B:
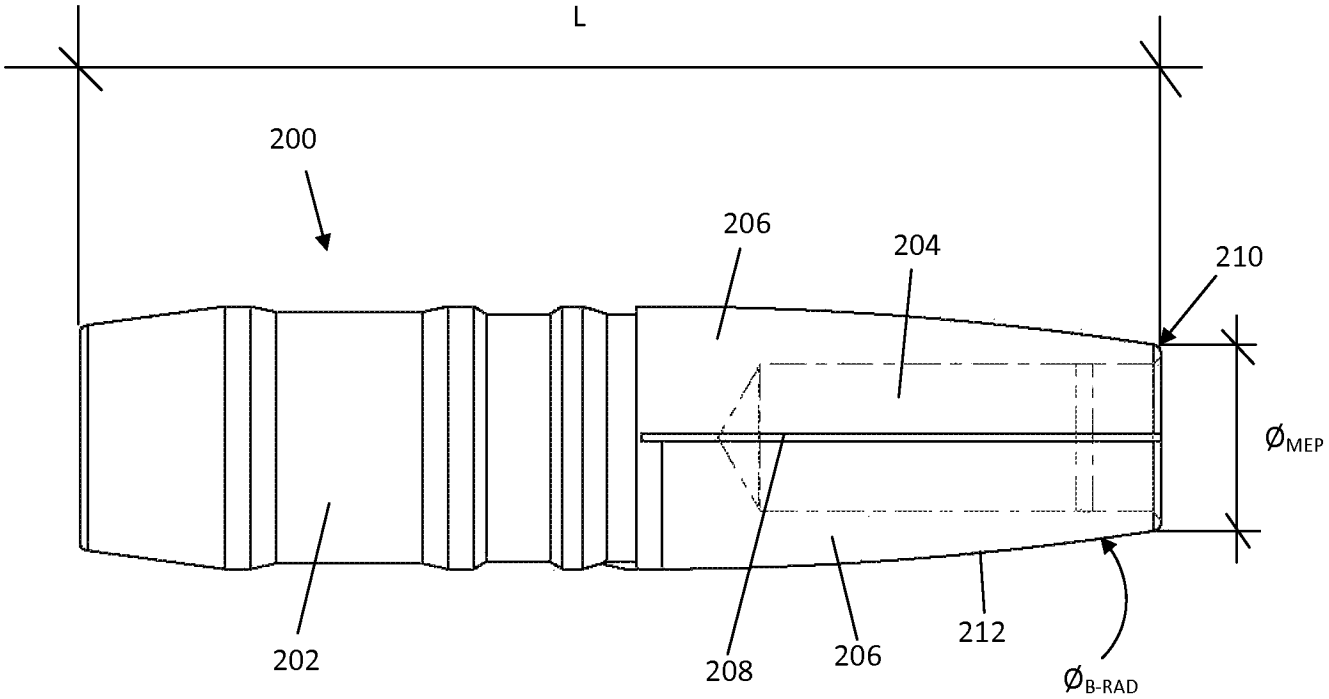
FIG. 2B is a side view of the expanding subsonic projectile of FIG. 2A.
Figure 2C:
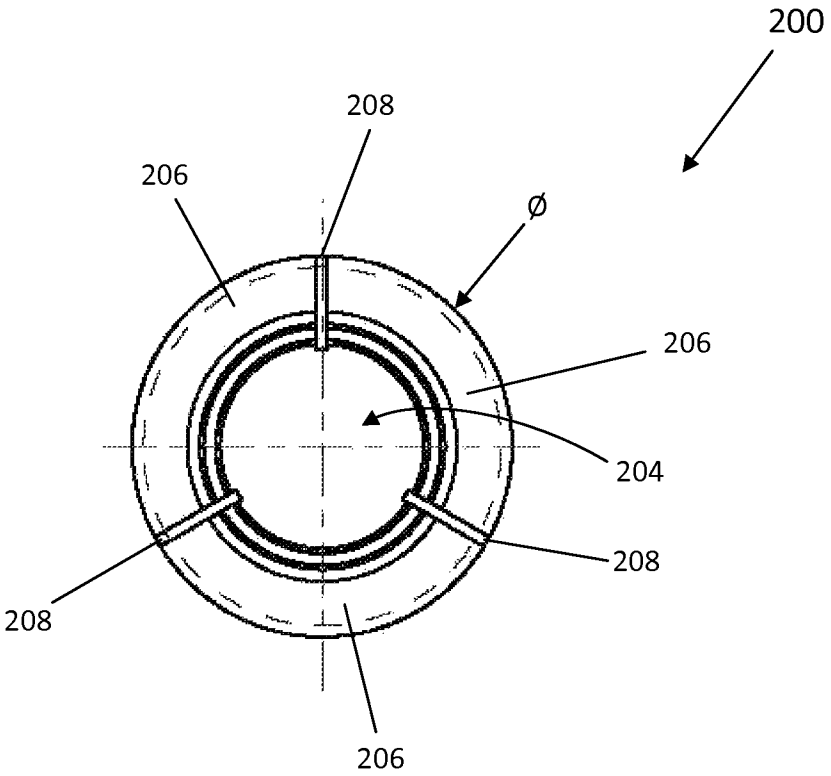
FIG. 2C is an end view of the expanding subsonic projectile of FIG. 2A.
Figure 2D:
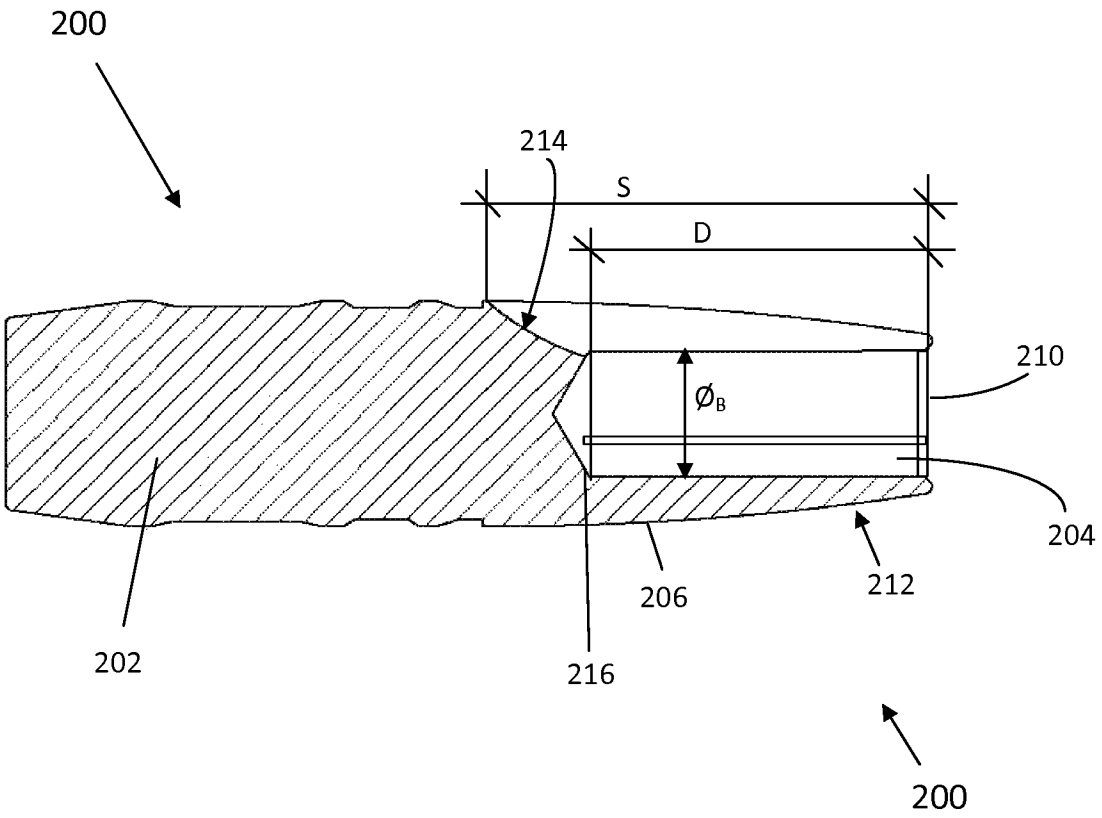
FIG. 2D is a side sectional view of the expanding subsonic projectile of FIG. 2A.

FIGS. 1A and 1B depict views of a cartridge 100 utilizing an expanding subsonic projectile 200 and an insert or payload bullet 300. The cartridge 100 includes an annular casing 102 having a primer (not shown) disposed at a first end 104 thereof, as well-known in the art. The casing 102 includes an open second end 106 into which the projectile 200 is inserted during manufacture and assembly. The interior of the casing 102 is filled with a propellant (e.g., gunpowder) that is ignited by the primer. This ignition discharges the projectile 200 from a firearm, such as a rifle. In so-called "automatic weapons," the force of the explosion is sufficient to both discharge the projectile and cycle a new cartridge into the weapon's firing chamber. The projectile 200 includes a body 202 that at least partially defines a hollow bore 204 that is open at a meplat 210 of the projectile 200. The bore 204 is surrounded by a plurality of petals 206. Adjacent petals 206 are spaced from each other by slots 208. The construction and performance of the projectile 200 is described in further detail herein. The insert 300 is disposed in the bore 204 and projects at least partially therefrom. A tip 302, leading section 304, and a portion of a waist 306 extend beyond a reference plane P defined by the meplat 210. A trailing section 308 of the insert 300 is disposed within the bore 204. The construction and performance of the insert 300 is described in further detail herein.

FIGS. 2A-2D depict various views of an expanding subsonic projectile 200, also referred to herein as a payload bullet, in accordance with one embodiment of the technology. As described in brief above, the projectile 200 includes a body 202 having a plurality of petals 206 surrounding a hollow bore 204 that is open at the meplat 210 of the projectile 200. The petals 206 are separated from each other by slots 208.

The projectile body 202 has a length L and a caliber Ø (e.g., the maximum body diameter). The bore 204 has a depth D, as measured along an axis A of the projectile body 202, from the meplat 210. The meplat 210 has a meplat diameter $Ø_{MEP}$ at the reference plane P. The bore 204 comprises a bore diameter $Ø_B$. The depicted projectile body 202 includes three petals 206, separated by an equal number of slots 208. In other embodiments, a greater or fewer number of petals may be utilized as required or desired for a particular application. Projectiles having as few as two or as many as eight petals are contemplated. As can be seen specifically in FIG. 2C, the slots 208 are disposed at equal distances about the axis A of the body 202. Specifically, they are disposed at about 0°, about 120°, and about 240°. Uneven spacing may also be utilized, although such a configuration may adversely affect expansion of the projectile 200 as it strikes a target. The slots 208 extend from an outer surface 212 of the petals 206 and intersect the bore 204. At the base 216 of the bore 204, the slots 208 are formed by a radius 214 that extends from the base 216 of the bore 204 to the outer surface 212 of the body 202. This radius 214 forms a portion of a length S of each slot 208, such that the petals 206 may more easily expand when hitting a target. The length S is measured from the meplat 210 of the body 202. The petals 206 define a body ogive radius $O_{B\text{-}RAD}$ of the projectile 200, as described in further detail below.

Figure 3A:
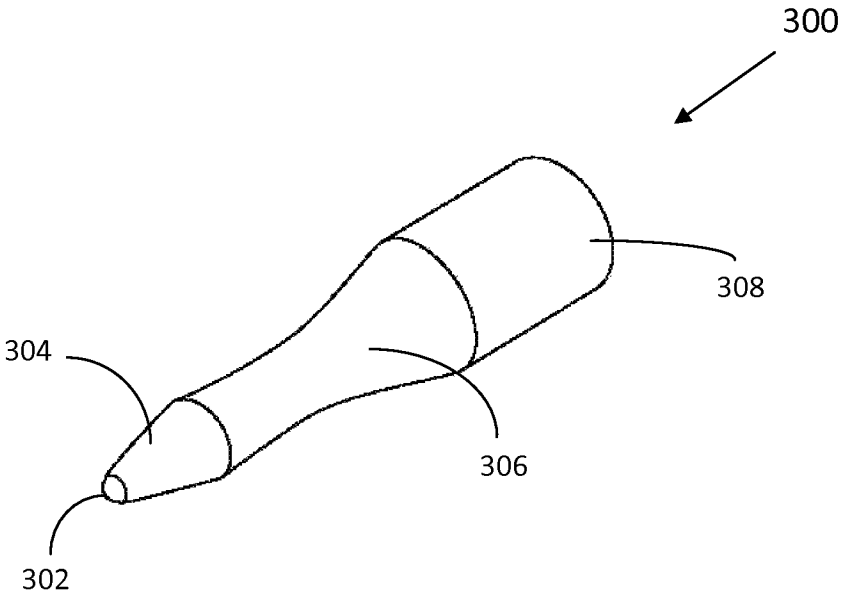
FIG. 3A is a perspective view of an embodiment of an insert.
Figure 3B:
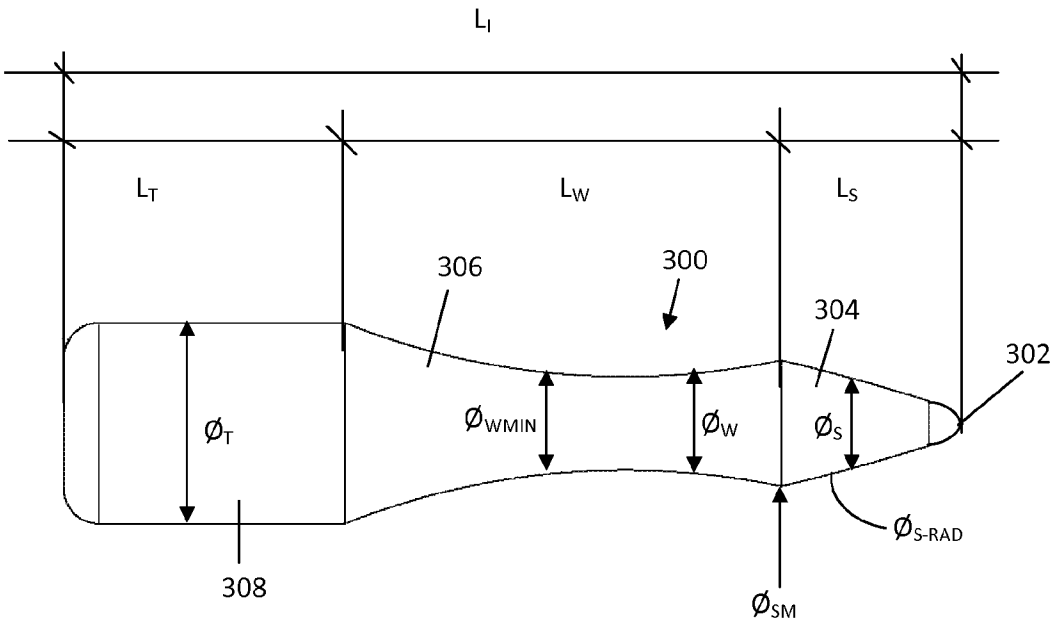
FIG. 3B is a side view of the insert of FIG. 3A.
Figure 3C:
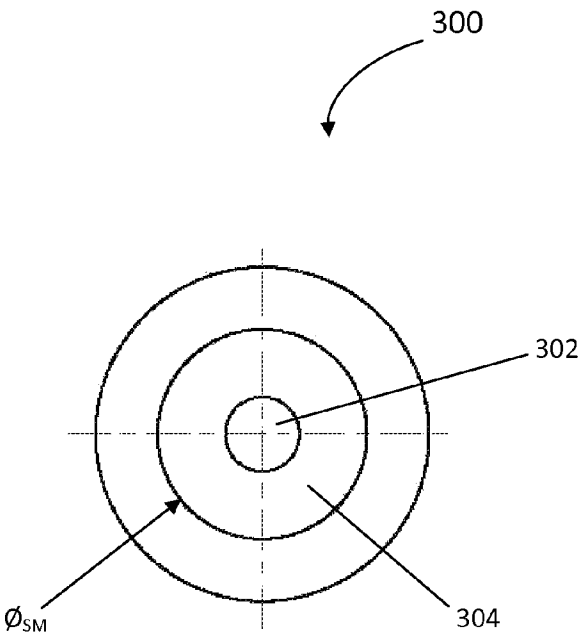
FIG. 3C is an end view of the insert of FIG. 3A.
Figure 4:
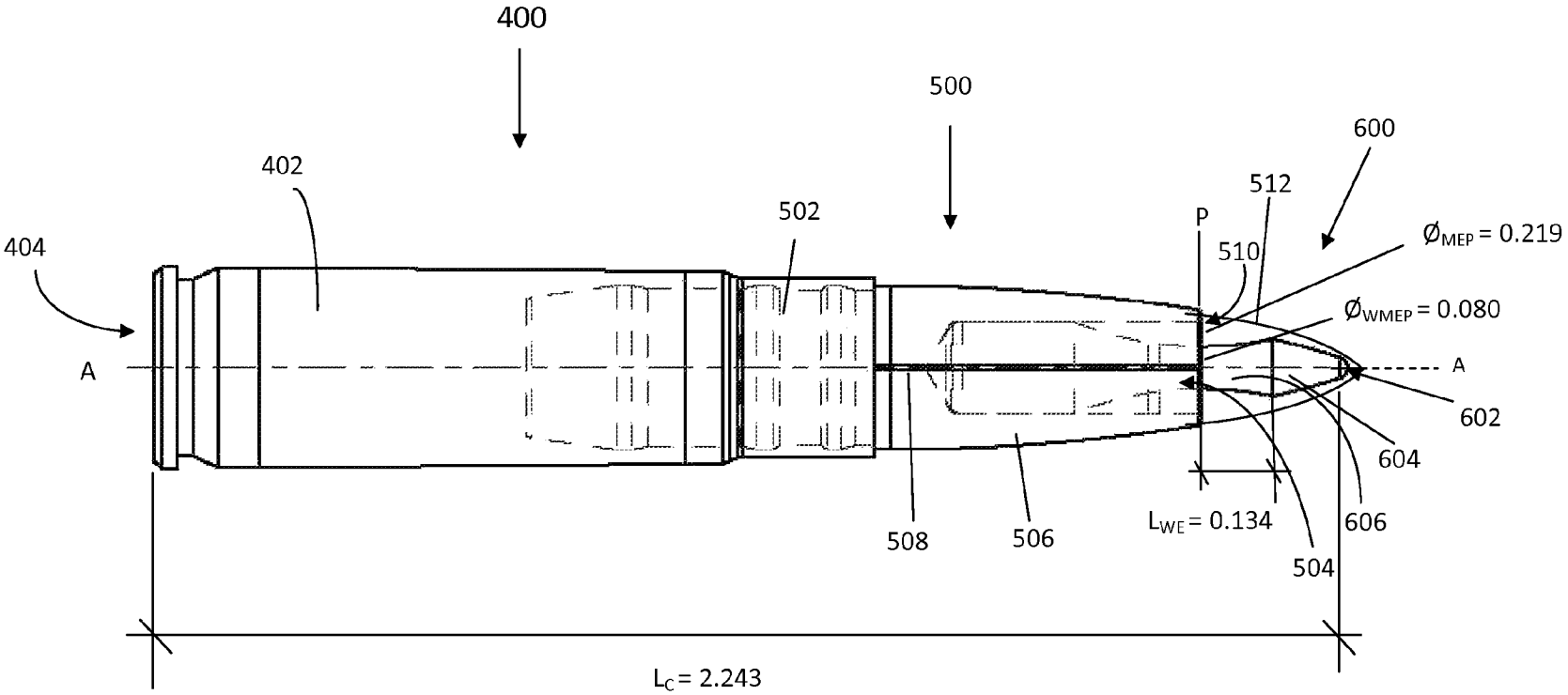
FIGS. 4-6B depict various views of another embodiment of an expanding subsonic projectile.
Figure 5A:
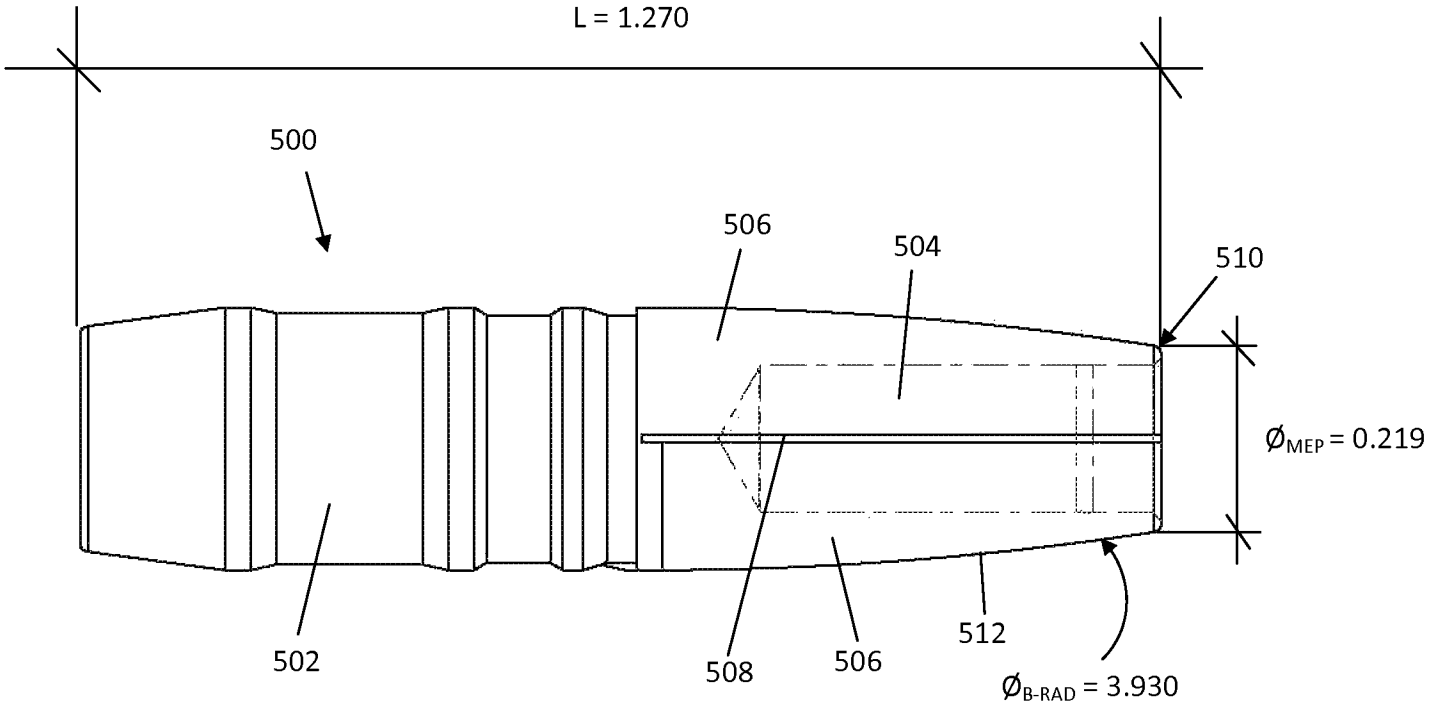
Figure 5B:
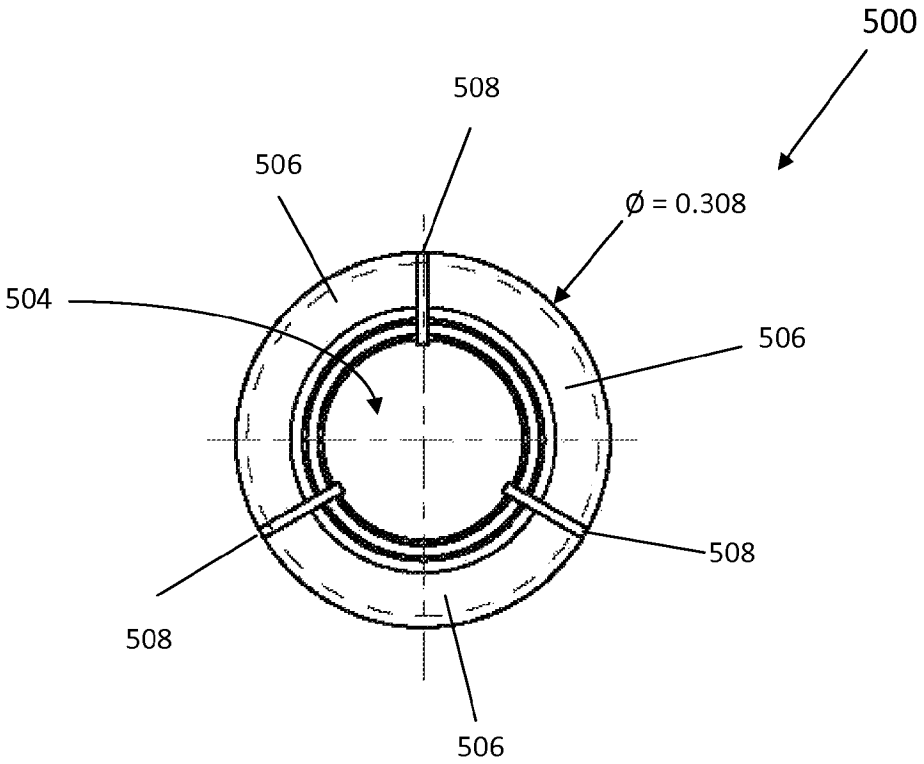
Figure 5C:
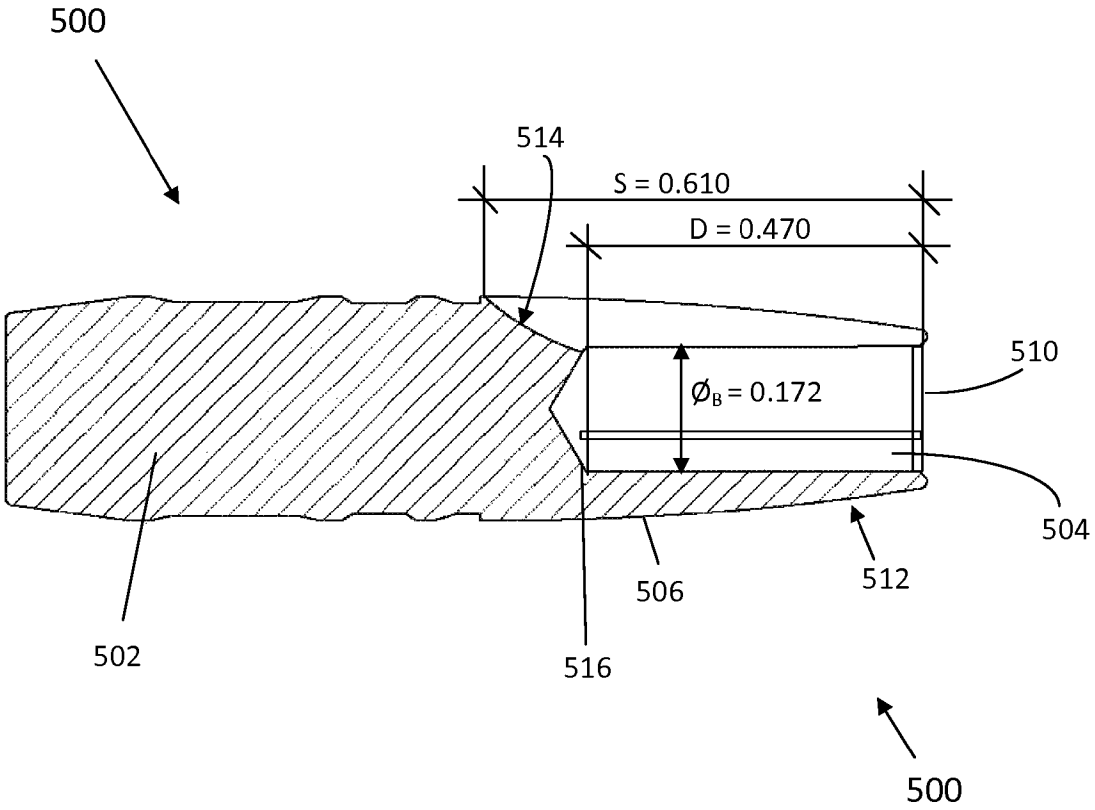
Figure 6A:
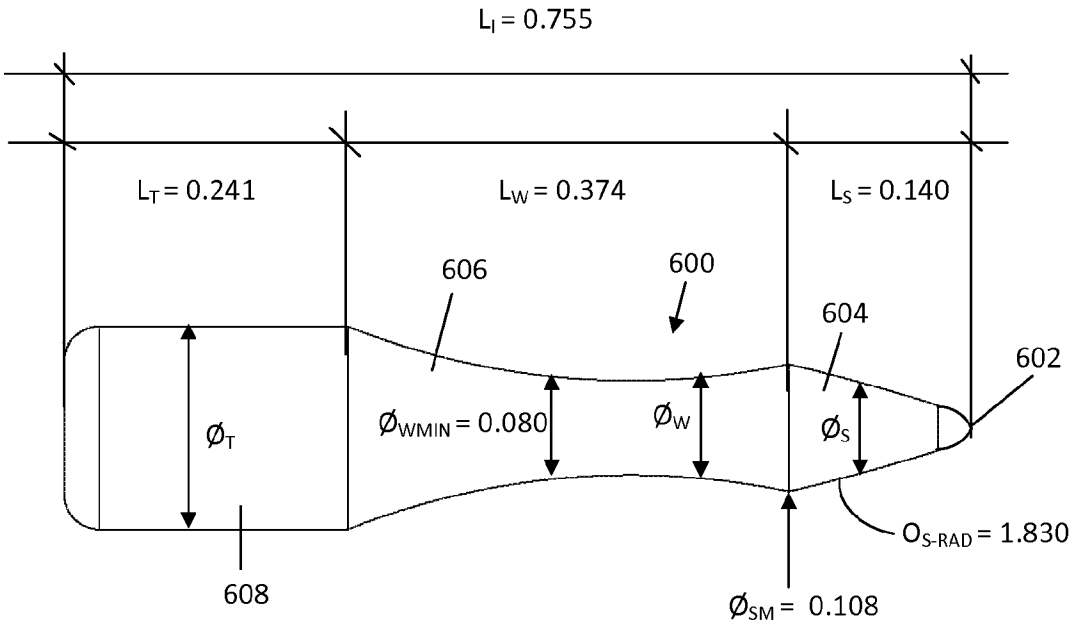
Figure 6B:
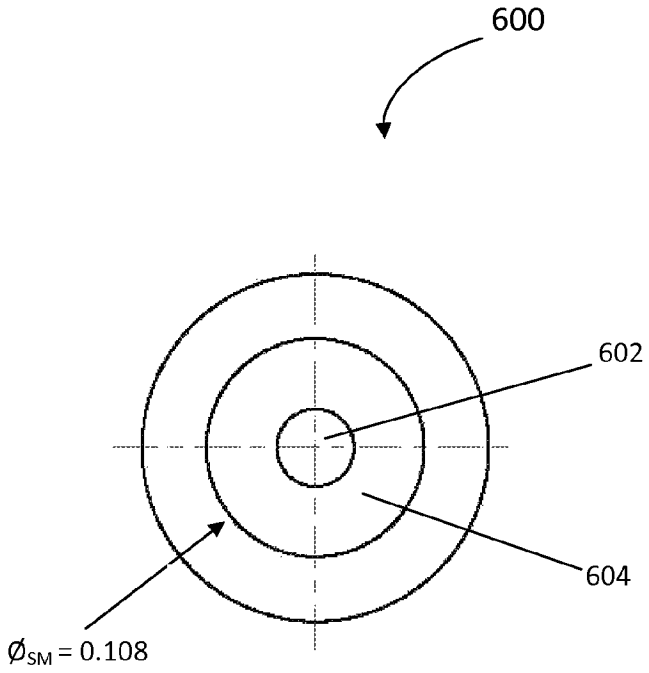

FIGS. 3A-3C depict various views of the insert 300, in accordance with one embodiment of the technology. The insert 300 includes a tip 302 disposed on the axis A, when the insert 300 is inserted into the bore 204. The depicted insert 300 defines three body portions 304, 306, 308. The leading section 304 extends from the tip 302 and includes an expanding leading section diameter $Ø_S$ that expands along the length of the axis A. The leading section 304 includes a leading section ogive radius $Ø_{S\text{-}RAD}$. At a maximum section diameter $Ø_{SM}$, the leading section 304 meets the waist 306. The waist 306 includes a waist diameter $Ø_W$ that decreases or contracts along the length of the axis A, to a minimum waist diameter $Ø_{WMIN}$. Thereafter, the waist diameter $Ø_W$ increases or expands along the length of the axis A, to the trailing section 308. The trailing section 308 includes a trailing diameter $Ø_T$ that is substantially the same as the bore diameter $Ø_B$. This helps secure the insert 300 in the bore 204. Additional dimensions can be used to further characterize the insert 300. For example, the lengths $L_S$, $L_W$, $L_T$, the leading section 304, waist 306, and trailing section 308, respectively, may define the functionality of the insert 300, which has a length $L_I$.

Typically, expanding projectiles are manufactured of lead or copper-jacketed lead. In a subsonic application, there is very little energy in the moving projectile. Accordingly, a very soft material such as lead is used as the media for expansion. Lead, however, expands erratically, deforming randomly when it comes in contact with any hard surface, be it hide, hair, bone, etc. Once a lead projectile expands, often with a misshapen lump on the front of the projectile, it slows down quickly and changes its path based on the resistance of the misshapen lump at the tip. The expanding subsonic projectile described herein, however, may be monolithic solid copper or brass. The insert 300 may be manufactured of copper, aluminum, or other materials. Other acceptable materials include copper-jacketed lead, copper-jacketed zinc, copper-jacketed tin, powdered copper, powdered brass, powdered tungsten matrix, and like materials. The projectile expands only when the hydraulic energy inside the projectile exceeds the tensile strength of the body 202. Thus, the projectile only expands when it hits a so-called "wet target." Wet targets include, for example, animals and persons, as well as water (in discharge testing tanks), and gel ordnance test blocks. Thus, the projectiles described herein are barrier-blind to hide, hair, bone, clothing, drywall, car doors, etc. Barriers that would destroy a lead or lead-core projectile are easily breached with a projectile manufactured as described herein. Also, in projectiles where the petals are arranged symmetrically about the axis, the expansion is substantially predictable.

Returning to FIG. 1B, the waist 306 also includes a meplat waist diameter $Ø_{WMEP}$, where the waist 306 intersects the reference plane P at the meplat 210. An exposed length $L_{WE}$ of the waist 306 may extend forward of the meplat 210 (towards the tip 302). Additionally, the cartridge 100 includes a cartridge length $L_C$ measured from the tip 302 to the first end 104 of the casing 102. The body 202 further defines a reference curve 212 extending from the meplat 210 to intersect the axis A. The reference curve 212 has a reference curve radius identical to the body ogive radius $O_{B\text{-}RAD}$. Both the tip 302 and leading section 304 of the insert 300 are contained within the reference curve 212. These structural relationships enable a projectile having a meplat to still be fed into an automatic weapon. Additionally, the profile or shape of the projectile reduces drag and increases ballistic coefficient.

The relationships between the various components of the cartridge 100 help ensure proper operation during firing and striking of a target. Once discharged from a firearm, the projectile (e.g., the body 202 and insert 300 as a unit) flies towards a target. When striking a wet target, fluid within the target is forced around the tip 302 of the insert 300. This fluid continues to spread outward as the projectile advances within the target along the length $L_S$ of the leading section 304, due to the expanding leading section diameter $Ø_S$. Once the fluid reaches the waist 306, a contracting portion of the waist diameter $Ø_W$ creates a low pressure region into which the fluid is drawn. At a position proximate the meplat waist diameter $Ø_{WMEP}$, the fluid is forced into the bore 204. Beyond the minimum waist diameter $Ø_{WMIN}$, an expanding portion of the waist diameter $Ø_W$ forces the fluid outward into the petals 206 of the body 202. As the petals 206 spread, the hydrostatic force acts further upon the slightly spread petals 206 forcing them to expand to their maximum expansion point, as the projectile advances in the target. Depending on the material utilized in manufacture of the body 202, one or more of the petals 206 may break from the main portion of the body 202.

Thus, in the absence of further failure of individual components, as many as five discrete components (three petals 206, the insert 300, and the remaining portion of the body 202) travel at high speed through the target, likely resulting in more damage and a cleaner kill.

The various dimensions of the components described above may be modified as required or desired for a particular application. Certain ratios have been discovered to be particularly beneficial to ensure proper expansion during contact with a wet target as well as to ensure proper feeding from a magazine of an automatic weapon. For example, the bore depth D may be about 35% to about 40% of the body length L. The bore depth D may be also about 75% to about 80% of the slot length S. The slot length S may be about 45% to about 50% the body length L. The leading section length $L_S$ can be about 15% to about 20% of the total length of the insert $L_I$. The exposed waist length $L_{WE}$ may be about 95% to about 100% of the leading section length $L_S$. Additionally, the meplat waist diameter $Ø_{WMEP}$ can be about 45% to about 50% of the bore diameter $Ø_B$. The meplat waist diameter $Ø_{WMEP}$ can be about 35% to about 40% of the maximum leading section diameter $Ø_{SM}$. The meplat waist diameter $Ø_{WMEP}$ can be about 45% to about 50% of the bore diameter $Ø_B$. Other dimensional relationships are contemplated. The dimensions of the various elements of the disclosed projectiles assist in enabling those projectiles to expand when hitting a wet target, after being discharged from a weapon at a subsonic speed.

Example 1

FIGS. 4-6B depict an embodiment of an expanding subsonic projectile, in accordance with the technologies described herein. The reference numerals utilized in FIGS. 4-6B are consistent with those depicted in FIGS. 2A-2D. Accordingly, those elements are generally not described further. The projectile is manufactured to the following specifications, identified in Table 1 below.

TABLE 1

EXAMPLE 1 DIMENSIONS

| Dimension | Inches (unless noted) |
|---|---|
| Cartridge Length, $L_C$ | 2.243 |
| Body Length, L | 1.270 |
| Body Caliber, Ø | 0.308 |
| Meplat Diameter, $Ø_{MEP}$ | 0.219 |
| Bore Depth, D | 0.470 |
| Bore Diameter, $Ø_B$ | 0.172 |
| Slot Length, S | 0.610 |
| Body Ogive Radius, $O_{B\text{-}RAD}$ | 3.930 |
| Body Ogive | 12.8 (unitless) |
| Insert Length, $L_I$ | 0.755 |
| Leading Section Length, $L_S$ | 0.140 |
| Waist Length, $L_W$ | 0.374 |
| Trailing Section Length, $L_T$ | 0.241 |
| Leading Section Diameter, $Ø_S$ | Varies |
| Leading Section Max. Diameter, $Ø_{SM}$ | 0.108 |
| Leading Section Ogive Radius, $O_{S\text{-}RAD}$ | 1.830 |
| Leading Section Ogive | 16.9 (unitless) |
| Waist Diameter, $Ø_W$ | Varies |
| Waist Min. Diameter, $Ø_{WMIN}$ | 0.080 |
| Meplat Waist Diameter, $Ø_{WMEP}$ | 0.080 |
| Exposed Waist Length, $L_{WE}$ | 0.134 |

Manufacturing tolerances are not reflected in the figures or Table 1. Thus, for the depicted body 500 having a body ogive radius $O_{B\text{-}RAD}$ of 3.930 inches and a caliber Ø of 0.308 inches, the ogive is about 12.8 calibers, since ogive equals $Ø_{B\text{-}RAD}$ divided by θ. Additionally, for the insert 600 having a leading section ogive radius $Ø_{S\text{-}RAD}$ and a leading section maximum diameter of $Ø_{SM}$ (i.e., caliber), the ogive is about 16.9 calibers. An ogive expressed in calibers is scalable.

The embodiment depicted in FIGS. 4-6C is particularly useful since the protruding tip 602 (being disposed within the reference curve 512) allows the body 402 having a meplat 510 to be compatible with magazine feeding in automatic and semi-automatic firearms. In contrast, typical expanding lead or lead-core subsonic projectiles must have blunt-shaped meplat, since a larger surface area is generally required for expansion. However, such blunt-shaped projectiles (e.g., having a meplat diameter $Ø_{MEP}$ greater than about 30% of the body caliber Ø) cannot be fed from a magazine. The body 500, however, has a meplat diameter $Ø_{MEP}$ of about 71% of the body caliber Ø. A cartridge 400 having such a body 500 can still be fed from a magazine, however, because the tip 602 aligns the cartridge during feeding. The body projectile described in accordance with EXAMPLE 1 was discharged at a subsonic velocity from a weapon into a 10% ordnance gelatin test block. The results of this test are presented below.

Test Summary:

A 170 gr projectile (with insert described in EXAMPLE 1) is designed for 0.308 subsonic applications in bolt or single shot weapons with a 1:10 twist or tighter. The subsonic projectile is designed to penetrate approximately 1.5 inches in 10% gel then expand and fracture the petals. The petals, having extremely sharp edges, cut soft tissue very well and radiate outward creating additional wound paths. In addition to the petals, the 20 gr insert is released creating another wound channel. After the controlled fracturing process and the creation of the temporary cavity, the bullet base, with a truncated nose, penetrates in a straight path to a final depth of greater than 18 inches.

Projectile Specification:

| | |
|---|---|
| Weight | 170 gr with 20 gr insert |
| Length | 1.235" |
| Bc(G1) | 0.531 theoretical, calculated |

Due to limitations in calculating a dual-density or tri-density ballistic coefficient, the following method was used. The bullet was designed using a fixed density value and the design weight was documented. The bullet was then produced and the actual weight measured. The density value was then modified so the design weight and the actual weight are the same. The ballistic coefficient was calculated from this homogenous density value.

Ordnance Gel Specification:

The projectile was discharged into a 10% ballistic ordnance gelatin test block manufactured and calibrated in accordance with the FBI Ammunition Testing Protocol, developed by the FBI Academy Firearms Training Unit. The base powder material utilized for the 10% ordnance gelatin test block was VYSE™ Professional Grade Ballistic & Ordnance Gelatin Powder available from Gelatin Innovations, of Schiller Park, Ill. The block was manufactured at the test site in accordance with the formulations and instructions provided by the powder manufacturer. After manufacture of the gelatin test block, the test block was calibrated. Calibration requires discharging a 0.177 steel BB at 590 feet per second (fps), plus or minus 15 fps, into the gelatin test block. The test block is considered calibrated if the shot penetrates 8.5 centimeters (cm), plus or minus 1 cm (that is, 2.95 inches-3.74 inches). The calibrated block is then used in the terminal performance testing of the projectile.

Terminal Performance Testing:

| | |
|---|---|
| Shot Velocity | 1,020 fps |
| Initial Expansion Depth | 1.8" approximate |
| Petal Depth | 6.0" approximate |
| Petal Radius | 2.5" approximate deviation from center |
| Insert Depth | 11.0" approximate |
| Base Depth | 17"+ |
| Retained Base Weight | 108 gr |

The projectile 400, when utilized in a cartridge having an appropriate casing and primer (such as a 300 Blackout cartridge), can be fed from a magazine of five, 10, 20, 30, and 60 rounds capacity.

Manufacture of expanding subsonic projectiles consistent with the technologies described herein may be by processes typically used in the manufacture of other projectiles. The projectiles may be cast from molten material, or formed from powdered metal alloys. Projections in the mold may form the depicted slots and bore, or the slots and bore may be cut into the projectiles after casting. The projectiles, inserts, casings, primers, and propellants may be assembled using one or more pieces of automated equipment. In some embodiments, the inserts may be inserted into the projectiles, then shipped to a second location for assembly into a final cartridge.

Unless otherwise indicated, all numbers expressing dimensions, speed, weight, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present technology.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents that may otherwise be afforded a particular value. Further, unless otherwise stated, the term "about" shall expressly include "exactly," consistent with the discussions regarding ranges and numerical data. Lengths, sizes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. This same principle applies to ranges reciting only one numerical value. Furthermore, such an interpretation should apply regardless of the breadth of the range or the characteristics being described.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An expanding subsonic projectile comprising:

a body comprising a meplat, a body ogive radius, and a reference curve comprising a reference curve radius identical to the body ogive radius, the body at least partially defining a hollow bore having a bore diameter; and an insert disposed at least partially in the bore, wherein the insert comprises:

an insert axis, wherein the reference curve extends from the meplat to the insert axis;

a tip disposed on the insert axis;

a leading section extending from the tip towards the meplat, wherein the leading section comprises an expanding section diameter along the insert axis from the tip towards the meplat, and wherein the tip and leading section are contained within the reference curve; and a waist extending from the leading section towards the meplat, wherein the waist comprises a contracting waist diameter along the insert axis from the leading section towards the meplat.

2. The expanding subsonic projectile of claim 1, wherein the body defines a maximum body diameter and a meplat body diameter of greater than about 30% of the maximum body diameter.

3. The expanding subsonic projectile of claim 1, wherein the body defines a maximum body diameter and a meplat body diameter of about 70% of the maximum body diameter.

4. The expanding subsonic projectile of claim 1, wherein the insert and bore form a friction fit.

5. The expanding subsonic projectile of claim 1, wherein the body comprises a plurality of discrete petals, wherein each petal is separated from an adjacent petal by a slot defined by the body.

6. The expanding subsonic projectile of claim 5, wherein the body comprises three petals.

7. The expanding subsonic projectile of claim 1, wherein the leading section comprises a maximum section diameter between about 60% and about 65% of the bore diameter.

8. The expanding subsonic projectile of claim 7, wherein the waist comprises a waist diameter at the meplat, wherein the waist diameter at the meplat is between about 35% and about 40% of the maximum section diameter.

9. The expanding subsonic projectile of claim 8, wherein the waist diameter at the meplat is between about 45% and about 50% of the bore diameter.

10. The expanding subsonic projectile of claim 1, further comprising a meplat distance from the tip to the meplat and a leading section distance from the tip to the waist, wherein the leading section distance is between about 95% and about 100% of the meplat distance.

11. The expanding subsonic projectile of claim 5, wherein the insert is adapted to direct a fluid flow within the bore towards the plurality of discrete petals when the projectile is discharged from a firearm at a subsonic speed into a wet target.

12. A cartridge comprising:

a casing;

a primer disposed at a first end of the casing;

a body at least partially defining a hollow bore and comprising a meplat;

an insert disposed at least partially in the bore, wherein the insert comprises an insert axis, a tip, and a leading section, and wherein the body comprises a body ogive radius and defines a reference curve extending from the meplat to the insert axis, wherein the reference curve comprises a reference curve radius identical to the body ogive radius, and wherein the tip and leading section are contained within the reference curve.

13. The cartridge of claim 12, wherein the leading section extends from the tip towards the meplat, wherein the leading section comprises an expanding section diameter along the insert axis from the tip towards the meplat.

14. The cartridge of claim 13, further comprising a waist extending from the leading section towards the meplat, wherein the waist comprises a contracting waist diameter along the insert axis from the leading section towards the meplat.

15. The cartridge of claim 12, wherein the leading section comprises a maximum section diameter between about 60% and about 65% of the bore diameter.

16. The cartridge of claim 15, wherein the waist comprises a waist diameter at the meplat, wherein the waist diameter at the meplat is between about 35% and about 40% of the maximum section diameter.

17. The cartridge of claim 16, wherein the waist diameter at the meplat is between about 45% and about 50% of the bore diameter.

18. The cartridge of claim 12, further comprising a meplat distance from the tip to the meplat and a leading section distance from the tip to the waist, wherein the leading section distance is between about 95% and about 100% of the meplat distance.

19. The cartridge of claim 12, wherein the body comprises a plurality of discrete petals, wherein each petal is separated from an adjacent petal by a slot defined by the body, and wherein the insert is adapted to direct a fluid flow within the bore towards the plurality of discrete petals when the projectile is discharged from a firearm at a subsonic speed into a wet target.

* * * * *